United States Patent [19]

Taylor

[11] 3,940,137

[45] Feb. 24, 1976

[54] POLE VAULTING GAME APPARATUS

[76] Inventor: Cecil R. Taylor, 1232 S. Spring St., Independence, Mo. 64055

[22] Filed: Apr. 28, 1975

[21] Appl. No.: 572,467

[52] U.S. Cl. ..... 273/85 C; 124/4; 124/6; 272/59 C; 273/85 D; 273/101; 273/102.4; 273/106 R

[51] Int. Cl.[2] ..... A63F 9/02

[58] Field of Search ..... 273/1 R, 85 R, 85 C, 85 D, 273/102.4, 101, 106, 106.5; 124/4, 6, 7; 272/59 C

[56] References Cited

UNITED STATES PATENTS

| | | | |
|---|---|---|---|
| 217,424 | 7/1879 | Stock et al. | 124/4 |
| 841,611 | 1/1907 | Alsop | 273/102.4 |
| 2,113,826 | 4/1938 | Carpenter | 272/59 C |
| 2,827,116 | 3/1958 | Zalovcik | 272/59 C X |
| 3,107,091 | 10/1963 | Jenkins | 272/59 C |
| 3,222,064 | 12/1965 | Langton | 272/59 C |
| 3,630,186 | 12/1971 | Babyn | 273/106.5 B X |

FOREIGN PATENTS OR APPLICATIONS

| | | | |
|---|---|---|---|
| 276,176 | 6/1951 | Switzerland | 124/4 |

OTHER PUBLICATIONS

Du Reglage des Fusils de Chasse – Mousseaux p. 7, 8–1921.

Playthings Magazine, July, 1972 p. 67, Flutterfly.

*Primary Examiner*—Paul E. Shapiro
*Attorney, Agent, or Firm*—John A. Hamilton

[57] ABSTRACT

A pole vaulting game apparatus consisting of a carriage movable along a track by a manually operable device, a flexible pole carried pivotally by the carriage and having a piece simulating the vaulter frictionally mounted thereon, and a trip device operable to pivot the pole sharply upwardly into a bowed position at a point in the travel of the carriage, and against a stop, whereby the vaulter piece leaves the pole in an upward direction, the object of the game being to cause the vaulter piece to pass over a horizontal bar as in normal pole vaulting.

10 Claims, 5 Drawing Figures

POLE VAULTING GAME APPARATUS

This invention relates to new and useful improvements in games of skill, and has as its principal object the provision of a table game suitable for use by persons of all ages which closely simulates the sport of pole vaulting.

Generally, the game apparatus includes a base having a straight track along which a wheeled carriage is movable by manually operable means. A flexible pole normally arranged horizontally and longitudinally of the track is pivoted at its forward end to the carriage on a horizontal transverse axis, and a game piece simulating a human vaulter is frictionally mounted on the rearward end of the pole. When the carriage reaches a position corresponding to the point at which an actual vaulter would take off, a trip device pivots the pole sharply upwardly, the inertia of the pole and the vaulter piece causing the pole to bow sharply in a vertical plane. After a predetermined further travel of the carriage along the track after the upward impetus of the trip device has terminated, but before the pole has straightened, the pole strikes a stop to halt its pivotal movement, but the vaulter piece is allowed to continue its upward and forward movement when its frictional grip on the pole is overcome by its momentum, hopefully to clear a horizontal bar normally positioned relative to the track, without dislodging said bar from its supports. Thus the toy closely simulates the conditions and problems of actual human pole vaulting, and its use requires the acquisition of considerable skills which will maintain continuing interest of persons of all ages for long periods of time.

Secondary objects of the invention are the inclusion of features in the apparatus requiring skills of operation closely simulating those required in actual pole vaulting such as a properly adjusted frictional "grip" of the vaulter piece on the pole, the development of speed of travel along the track, release of the vaulter piece from the pole while the pole is bowed to the greatest possible degree, in order that the piece will be propelled more nearly vertically, and proper forward or rearward adjustment of the bar relative to the take-off and release points.

Other objects are simplicity and economy of construction, and efficiency and reliability of operation.

Figure 1:
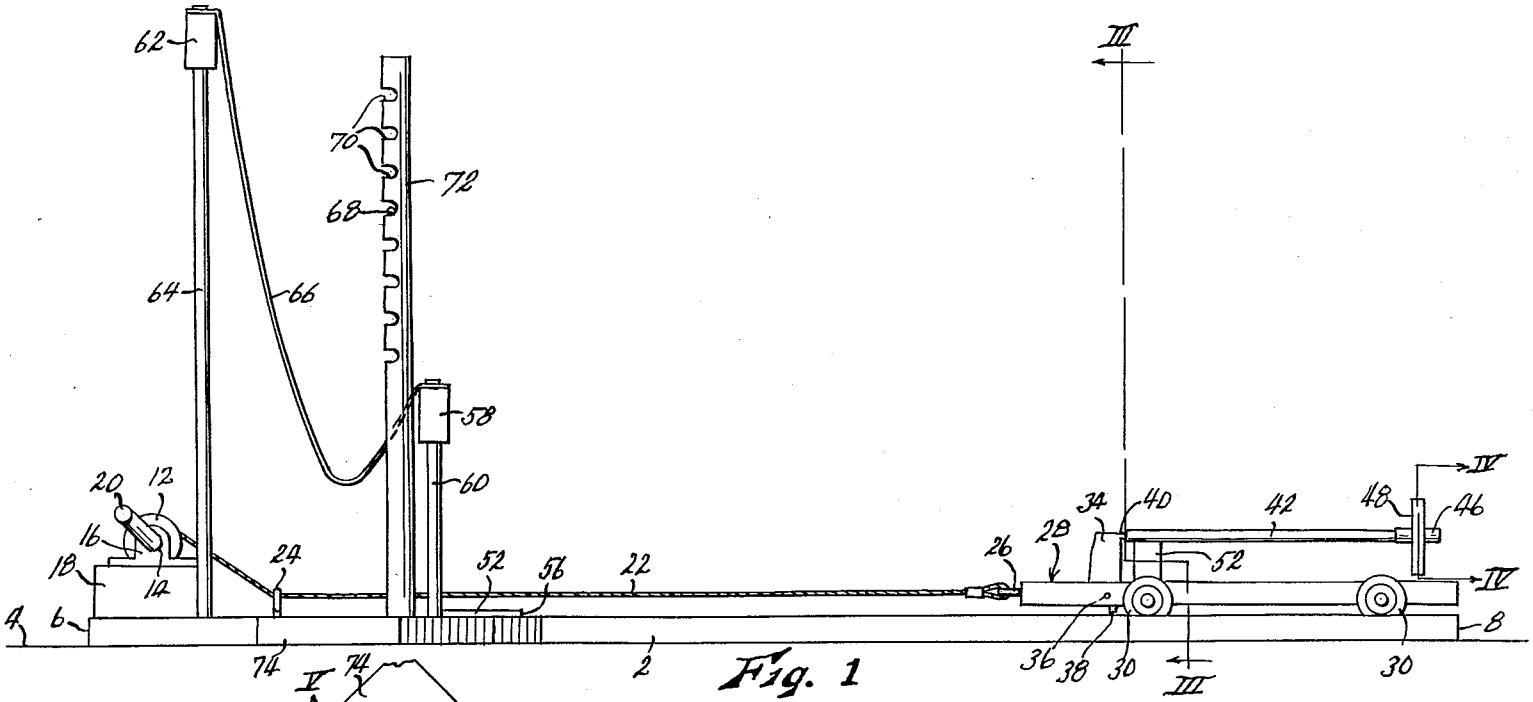
Figure 2:
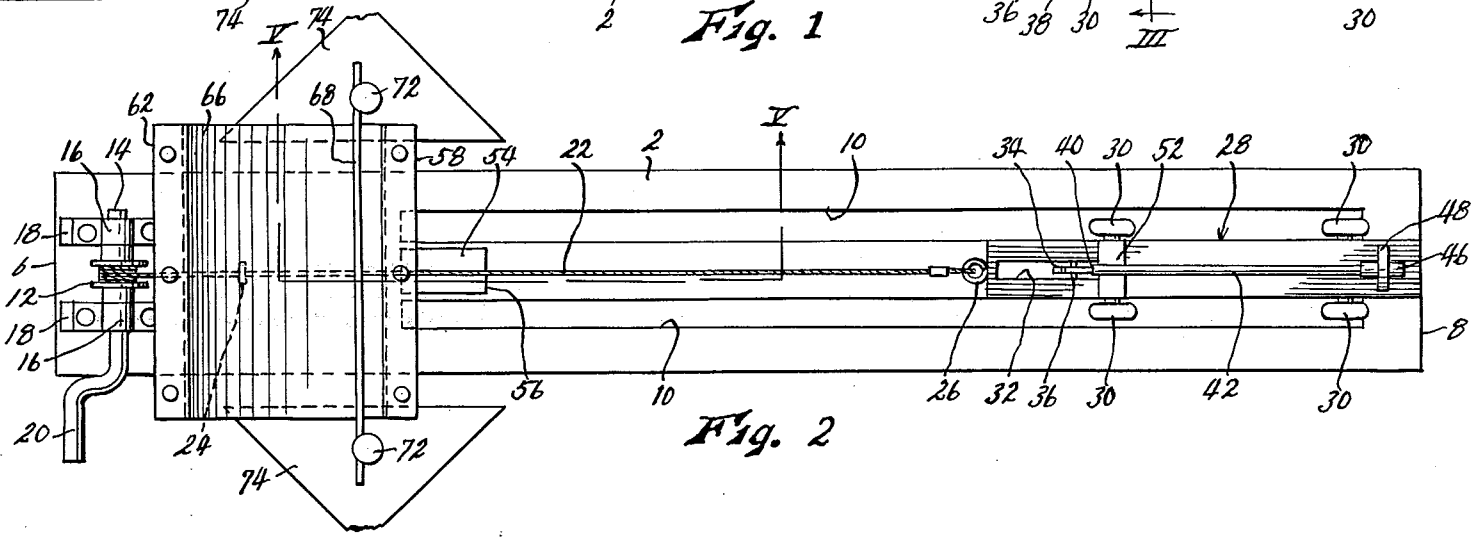
Figure 3:
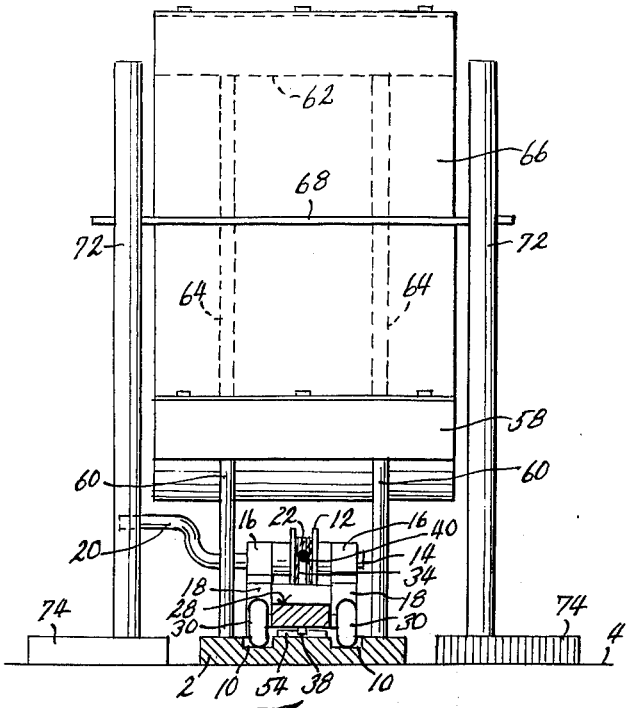
Figure 4:
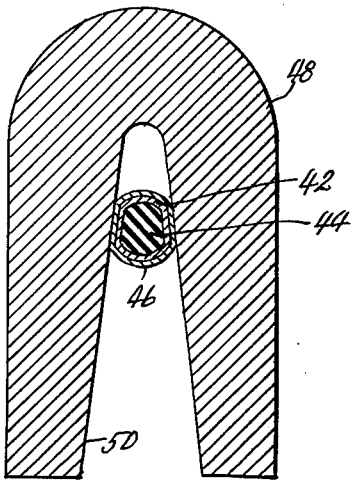
Figure 5:
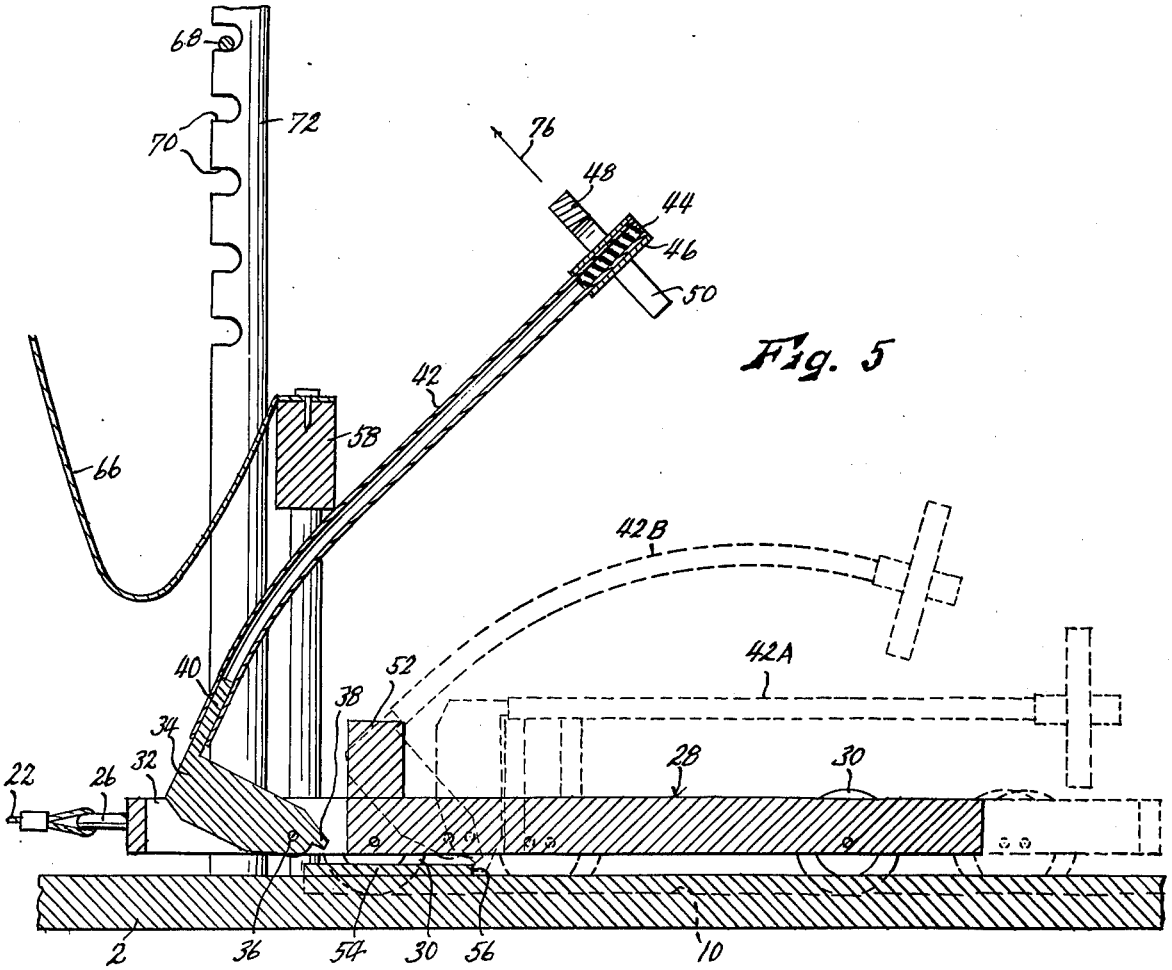

With these objects in view, as well as other objects which will appear in the course of the specification, reference will be had to the accompanying drawing, wherein:

FIG. 1 is a side elevational view of a pole vaulting game apparatus embodying the present invention, shown at the commencement of a vaulting attempt, FIG. 2 is a top plan view of the device as shown in FIG. 1, partially broken away, FIG. 3 is a sectional view taken on line III—III of FIG. 1, FIG. 4 is an enlarged sectional view taken on line IV—IV of FIG. 1, and FIG. 5 is an enlarged, fragmentary sectional view taken on line V—V of FIG. 2, showing the elements thereof in various stages of the operation thereof, two preliminary positions of the carriage and pole being shown in dotted lines, and the position at which the vaulter piece is released being shown in solid lines.

Like reference numerals apply to similar parts throughout the several views, and the numeral 2 applies to the base of the toy, which may be supported on a table 4, and which comprises a flat, elongated board which may be of any desired length, a length of about three feet having been used in developmental devices. End 6 thereof is designated its forward end, and end 8 is designated its rearward end. Formed longitudinally in its upper surface are a pair of parallel grooves 10. Said grooves constitute the tracks for the carriage to be described, and extend from a point closely adjacent rearward end 8 of the base to a point more distant from the forward end 6 of the base. Directly adjacent the forward end of the base, a drum 12 is carried on a horizontal transverse axle 14, said axle being journalled in bearings 16 mounted on pillow blocks 18 fixed to the base. One end of axle 14 extends outwardly, and is transversely offset to form a manually operable crank 20. Wound on drum 12 is a flexible string 22, which extends rearwardly and downwardly and is trained slidably through an eye member 24 fixed in the top surface of the base, and then extends horizontally rearwardly, being secured at its free end in an eye member 26 fixed to the forward end of a carriage designated generally by the numeral 28.

Carriage 28 also comprises an elongated board, narrower than base 2, extending parallel to said base and disposed thereabove, being supported at each side by a pair of wheels 30 engaged in one of base grooves 10, whereby the carriage is supported for rolling movement along the base. A slot 32 is formed vertically through the forward end portion of carriage 28, said slot being elongated longitudinally of said carriage. A pole lever 34, normally vertical as shown in FIG. 1, extends vertically through slot 32, and is freely pivoted therein intermediate its ends, on a horizontal transverse axis, by means of a pivot pin 36 carried by the carriage. At its lower end, said lever forms a forwardly facing trip finger 38 which, in the normal vertical position of the lever, extends below the carriage but does not engage the top surface of base 2. At its upper end, lever 34 is provided with a rearwardly extending spindle 40 which is horizontal when the lever is in its normal vertical position. The lever and its spindle are formed of a rigid material such as wood.

Fixed on spindle 40 is the forward end portion of a pole 42, which simulates the pole used in actual vaulting. Said pole is resiliently flexible, and may be tubular, spindle 40 being sized to fit snugly and frictionally therein. Actually, a plastic soda straw has served very well in this capacity, but this is of course optional, and the desired resilient strength of the pole may be selected as desired. In fact, as players develop skill at the game, they may develop a style leading to a preference for either stiffer or more limber poles, and this preference may be accomodated by providing a set of poles of different degrees of stiffness, which may be applied selectively to spindle 40. At its free end portion, pole 42 is provided with a filler plug 44 (see FIGS. 4 and 5) of a relatively firm, but still compressible, rubber or the like, and with an outer covering 46, of friction tape or the like, providing for more secure mounting of a vaulter piece 48 thereon, said vaulter piece simulating the actual human pole vaulter. As shown, said vaulter piece comprises a flat piece of wood or the like having a tapering notch 50 formed upwardly from the lower edge thereof, as best shown in FIG. 4. As indicated in FIg. 4, the vaulter piece is applied to the pole by pressing notch 50 thereof downwardly over the portion of the pole having outer covering 46, so that the cross-sectional contour of the pole is deformed as shown. The taper of the notch is such that, in conjunction with the friction covering of the pole and the resilience of its filler plug 44, the vaulter piece is held on the pole with a force sufficiently great that the vaulter piece will not fall away from the pole by gravity, and will in fact be held in place with a still greater force, depending on the degree to which the cross-sectional configuration of the pole has been deformed. This degree of deformation is determined by a player as he sets the piece on the pole, and as will appear its proper determination and setting is an important factor in determining the height of the vault obtained. The shape and design of the vaulting piece is of course a matter of design choice, so long as it is provided with notch 50. Also, various vaulting pieces 48 could be supplied with the game, interchangeably usable and having different weights to suit the playing styles and preferences of different contestants. When lever 34 is in its normal vertical position as shown in FIG. 1, pole 42 is supported in a horizontal position by a support block 52 fixed to the top surface of carriage 28 just behind slot 32 thereof.

Affixed to the top surface of base 2 between grooves 10, at about the forward end of said grooves, is a trip block 54. Said trip block is sufficiently thin vertically that carriage 28 passes freely thereover in its forward movement, but its rearward edge 56 is engaged by the depending finger 38 of lever 34 during said forward carriage movement, whereby pole 42 is pivoted upwardly and forwardly as indicated in FIG. 5. This action will be described in detail hereinbelow. A stop bar 58 extends horizontally, and transversely above base 2, forwardly of the rearward edge 56 of the trip block, preferably at such a spacing that if pole 42 is pivoted to a vertical position with lever finger 38 at edge 56 of the block, said pole will engage the rearward face of the stop bar. Stop bar 58 is supported by a pair of posts 60 anchored at their lower ends in base 2. A second horizontal transverse bar 62, higher than stop bar 58, is disposed farther forwardly than bar 58, preferably at an elevation greater than that to which vaulting piece 48 can be impelled, and is supported by a pair of posts 64 anchored at their lower ends in base 2. A "catching net" 66, which simulates the pit in which an actual pole vaulter lands after a vault, and which may consist of a length of pliable plastic film, is draped loosely between bars 58 and 62, its respective ends being tacked or otherwise secured to said bars. A bar 68, which the vaulting piece 48 must pass over in a successful vault, extends horizontally and transversely over net 66, at an elevation higher than that of bar 58, but lower than that of bar 62. Bar 68 is loosely supported adjacent each of its ends, in one of a series of vertically spaced apart, rearwardly opening notches 70 formed in a vertical post 72. Each post 72 is anchored at its lower end in a base 74, bases 74 being separate from base 2 and adapted to be supported on table 4 adjacent the respecively opposite sides of base 2, whereby bar 68 may be adjusted forwardly or rearwardly relative to stop bar 58.

In operation, a player first selects a pole 42 of the desired degree of resilient stiffness and mounts it on spindle 40 of pole lever 34, then selects a vaulting piece 48 of the desired weight, and presses notch 50 of said piece downwardly over the portion of said pole having friction covering 46. As will appear, the selection of a pole having the proper relationship to the weight of the vaulting piece, the point along the axial length of the pole at which the vaulting piece is attached, and the force with which the vaulting piece is pressed into engagement with the pole, are all important factors in determining the height of a successful vault to be accomplished. Carriage 28 is then moved manually to the rearward end of base 2, paying out string 22 from drum 12 to permit this placement, with carriage wheels 30 resting in track grooves 10 and pole 42 disposed horizontally and resting on support block 52.

Drum 12 is then turned by manual manipulation of crank 20 to cause string 22 to pull carriage 28 forwardly. As will be apparent, a greater carriage speed will produce a higher vault. The string could of course be pulled manually, but the provision of drum 12, preferably of a quite small diameter, turned by crank 20, also preferably of a small throw, renders the obtaining of a high carriage speed more difficult, and their usage is therefore preferred as they introduce a further element of manual skill and dexterity into the game.

As the carriage moves forwardly, pole 42 remains horizontal, and stationary relative to the carriage, until it approaches stop bar 58, and the depending trip finger 38 of pole lever 34 engages the rearward edge 56 of trip block 54. The relative positions of the parts at this instant is shown in FIG. 5 in dotted lines at position 42A of the pole. The engagement of the trip finger with the trip block, and the next subsequent small segment of forward movement of the carriage, causes the upper end of pole lever 34 to move forwardly, and pole 42 to be pivoted upwardly and forwardly, as shown at position 42B of the pole in FIG. 5. This action is accomplished very rapidly, with a "snapping" action, so far as lever 34 is concerned, but the inertia of the pole itself, and of the mass of vaulting piece 48, causes the pole to assume an upwardly convex bowed configuration, also as shown in FIG. 5, the degree of bowing depending on the speed and suddenness with which the lever is pivoted, and hence on the carriage speed. At the instant indicated by position 42B of the pole in FIG. 5, trip finger 38 clears the top surface of the trip block. This occurs before the pole could engage stop bar 58, even if said pole were still straight and unflexed.

As the forward movement of the carriage continues, the pole continues its upward and forward pivotal movement relative to the carriage, by reason of the momentum already imparted thereto, but since its upward acceleration stopped when finger 38 cleared the top surface of block 54, it immediately begins to straighten and lose its bowed configuration. However, depending again on carriage speed, the pole will still be partially flexed when an intermediate point of its length hits stop bar 58, as shown in the solid line position of the pole in FIG. 5. This engagement of the pole with the stop bar in effect "locks in" whatever degree of pole flexure still remains in that portion of the pole between lever 34 and its point of contact with bar 58, but the free end portion of the pole still behind bar 58 will continue to straighten, also as indicated, with a whip-like motion, before its upward motion is halted. At about this instant, if the frictional grip of piece 48 on the pole has been properly set, the upward momentum of the piece will cause it to be released from its frictional grip on the pole, and it will continue upwardly in free flight, generally in the direction of arrow 76 in FIG. 5. The object of the game is to cause vaulting piece 48 to pass over the top of bar 68, of course without dislodging said bar from notches 70 of its support posts 72, and to land within net 66.

It will be readily apparent that this toy or game closely simulates many of the problems, techniques and skills involved in actual human pole vaulting. For example, if the pole is too limply flexible in relation to the weight of the vaulting piece, it cannot supply the force necessary to propel the piece to greater heights as it moves through its whiplike motion. If the pole is too stiff in relation to the weight of the vaulting piece, the pole will not be adequately flexed, resulting inevitably in a more nearly horizontal release of the piece from the pole, and a reduction in the vaulting height obtained. Also, in many respects the height obtained is dependent on the speed of the carriage along the track, which corresponds to the running speed of a human vaulter, and in the present device depends on the player's dexterity in turning crank 20. The greater the carriage speed, the more flexure of the pole will remain when it hits stop bar 58, and the more nearly vertically piece 48 will be propelled, and the higher the vault will be although piece 48 must still have enough forward motion to pass rearwardly over bar 68. Human vaulters also sometimes fail to pass over the bar, even though they attain sufficient elevation to do so, if they lose their forward momentum. The frictional grip of piece 48 on the pole must also be properly set, not too loose and not too tight. If too loose, the piece may be dislodged from the pole before it reaches the optimum release position shown in solid lines in FIG. 5, or be discharged generally longitudinally from the free end of the pole by centrifugal force during the whiplike motion of the pole. A human vaulter also sometimes loses his grip on the pole. If the frictional mounting of the piece 48 on the pole is too tight, most or all of its momentum may be absorbed in effecting release from the pole, leaving little momentum to continue its upward course. A human vaulter also sometimes fails to release his grip on the pole. Bar 68 may be adjusted forwardly or rearwardly relative to the release point, as is done by a human vaulter, but only within limits, as the piece 48 must land on net 66.

Many of the factors discussed are interdependent, so that the change of one requires changes of others. Also, this permits a player to adapt the game to his particular skills. For example, he may use a stiffer pole for greater propulsion force on the vaulting piece, and a lighter vaulting pice so that a given propulsion force will throw it higher, if he finds he has the necessary skill to move the carriage at a sufficient speed to produce the required initial bowing of the pole. Lower carriage speeds generally require more limber poles, or heavier vaulting pieces, to produce the desired trajectory.

Thus it will be apparent that a toy which simulates actual pole vaulting with a high degree of fidelity has been produced. As a game, it offers excellent opportunities for a high degree of competition for any number of players, and which should retain interest for long periods of use since it offers the possibility of continued improvement by the development of judgment and manual skills.

While I have shown and described a specific embodiment of my invention, it will be readily apparent that many minor changes of structure and operation could be made without departing from the spirit of the invention.

What I claim as new and desire to protect by Letters Patent is:

1. A pole vaulting game apparatus comprising:

a. a base forming an elongated horizontal track, b. a carriage movable along said track, c. operating means manually operable to advance said carriage along said track, d. a pole carried by said carriage in a normally horizontal position but being pivoted to said carriage for upward and forward pivotal movement in the direction of carriage advancement, e. a vaulting piece adapted to be frictionally mounted on the free end portion of said pole and to be released transversely therefrom when the friction of its mounting is overcome, f. cooperating trip members carried by said base and said carriage and operable to pivot said pole upwardly relative to said carriage at a predetermined point in the travel of said carriage, g. a stop member operable to arrest the upward pivotal movement of said pole before it reaches a vertical position, whereupon said vaulting piece is dislodged from said pole and propelled therefrom in an upward trajectory, and h. a horizontal bar extending transversely of said base thereabove, the object of the game being to cause said vaulting piece to pass over said bar.

2. An apparatus as recited in claim 1 wherein said horizontal bar is provided with support members operable to support said bar at adjustable variable elevations, said horizontal bar being horizontally displaceable from said support members if struck by said vaulting piece.

3. An apparatus as recited in claim 2 wherein said support members are adjustably movable relative to said track in a direction longitudinal to said track.

4. An apparatus as recited in claim 1 wherein said cooperating trip members impel said pole pivotally upwardly, and become substantially inoperative before said pole engages said stop member, said pole continuing its upward movement by its momentum, said stop member being affixed to said base to be engaged by said pole at a more advanced position of said carriage, whereby the degree to which said pole will have pivoted toward a vertical position when it engages said stop member is determined by the speed of travel of said carriage as produced by said operating means.

5. An apparatus as recited in claim 1 wherein said carriage is provided with rotatable wheels engaged and guided in said track, and wherein said operating means comprises:

a. a drum rotatably mounted on said base forwardly of the the travel of said carriage, b. a manually operable crank operable to rotate said drum, and c. a flexible strand wound on said drum, extending therefrom, and secured to the forward end of said carriage.

6. An apparatus as recited in claim 1 wherein said pole is formed of resiliently flexible material, whereby to be transversely flexed into a bowed configuration by its own inertia and that of said vaulting piece as it is pivoted suddenly upwardly by said cooperating trip members, whereby it will remain at least partially flexed and its free end portion will be more nearly horizontal, when it engages said stop member.

7. An apparatus as recited in claim 6 wherein said cooperating trip members pivot said pole sharply upwardly, and become substantially inoperative, before said pole engages said stop member, said pole continuing upwardly by its own momentum, but immediately beginning to recover resiliently from its felxure, said stop member being fixedly related to said base to be engaged by said pole at a more advanced position of said carriage, whereby the degree to which said pole will have recovered from its flexure before it engages said stop member is determined by the speed of travel of said carriage.

8. An apparatus as recited in claim 6 wherein said vaulting piece is generally planar, having an inwardly tapering notch formed inwardly from one edge thereof, said notch being engageable transversely over the free end portion of said pole to form a frictional engagement therewith.

9. An apparatus as recited in claim 8 wherein said pole is tubular, the free end portion thereof being provided with an external covering providing frictional resistance to movement thereof relative to the walls of said vaulting piece notch, and with an internal filler of resiliently compressible material.

10. An apparatus as recited in claim 1 with the addition of a net consisting of a sheet of pliable material, and supporting means for a pair of opposite edges of said sheet whereby it is supported in loosely draped form beneath said horizontal bar.

* * * * *